US005617818A

United States Patent [19]

Lüders

[11] Patent Number: 5,617,818

[45] Date of Patent: Apr. 8, 1997

[54] MOUNTING ARRANGEMENT FOR A CAMSHAFT AND ASSOCIATED VALVE CONTROL ELEMENTS OF AN INTERNAL COMBUSTION ENGINE

[75] Inventor: Michael Lüders, Stuttgart, Germany

[73] Assignee: Mercedes-Benz AG, Stuttgart, Germany

[21] Appl. No.: 596,672

[22] Filed: Feb. 5, 1996

[30] Foreign Application Priority Data

Feb. 13, 1995 [DE] Germany ..... 195 04 637.4

[51] Int. Cl.[6] ..... F01L 1/04; F01L 1/18; F02F 1/24

[52] U.S. Cl. ..... 123/90.27; 123/90.39; 123/193.5

[58] Field of Search ..... 123/90.27, 90.38, 123/90.39, 90.4, 90.44, 90.45, 193.3, 193.5

[56] References Cited

U.S. PATENT DOCUMENTS

| | | | |
|---|---|---|---|
| 4,505,236 | 3/1985 | Nakamura | 123/90.27 |
| 5,095,861 | 3/1992 | Dove, Jr. | 123/90.39 |
| 5,101,777 | 4/1992 | Onishi et al. | 123/90.27 |
| 5,207,193 | 5/1993 | Sugimoto et al. | 123/90.27 |
| 5,297,506 | 3/1994 | Reckzugel et al. | 123/90.27 |
| 5,339,778 | 8/1994 | Reckzugel et al. | 123/90.39 |

FOREIGN PATENT DOCUMENTS

| | | |
|---|---|---|
| 3805590 | 9/1988 | Germany . |
| 3220724 | 8/1991 | Germany . |
| 2269855 | 2/1994 | United Kingdom . |

OTHER PUBLICATIONS

ATZ Automobiltechnische Zeitschrift 75 (1973) 3, pp. 78–79.

*Primary Examiner*—Weilun Lo
*Attorney, Agent, or Firm*—Klaus J. Bach

[57] ABSTRACT

In an arrangement for mounting a cam shaft and associated valve control elements on an internal combustion engine which has a cylinder head with intake and exhaust valves operated by an overhead cam shaft via rocker arms, the camshaft is supported on a cam shaft housing having spaced bearing blocks rotatably supporting the cam shaft and girders extend between the bearing blocks and have longitudinally extending bores receiving rocker arm support shafts and the girders have recesses wherein rocker arms are pivotally supported on the rocker arm support shaft extending through the recesses. The arrangement requires little mounting space on the cylinder head and the cam shaft housing can be mounted, preassembled with cam shaft and rocker arms, on the cylinder head.

13 Claims, 5 Drawing Sheets

1
5
20
19
18
9
7
10'
10
6
5
12'
13'
8
14
14d
22
14c
21
12
14b
13
6
15
14a
11c
11b
4
11a
3

MOUNTING ARRANGEMENT FOR A CAMSHAFT AND ASSOCIATED VALVE CONTROL ELEMENTS OF AN INTERNAL COMBUSTION ENGINE

BACKGROUND OF THE INVENTION

This invention relates to a mounting arrangement for a camshaft and associated valve control elements of an internal combustion engine with a number of spaced bearing sockets and bearing covers for supporting a cam shaft extending along the length of the cylinder head of the engine.

DE 32 20 724 A1 discloses an internal combustion engine with overhead cam shaft for operating the intake and exhaust valves during the combustion of the fuel/air mixture in the cylinders of the engine. The cam shaft extends lengthwise on the cylinder head and is rotatably supported by several cam shaft bearings which are arranged in spaced support intervals and include each a bearing socket and a bearing cover mounted thereon. The cam shaft operates rocker arms which control valves which open and close the intake and exhaust passages in the cylinder head. The rocker arms are rotatably supported by rocker arm support shafts which are supported in bores extending parallel to the axis of the camshaft. In this arrangement however, the rocker arm shafts may experience undesirable bending vibrations which prevent an accurate control of the valves, because the rocker arm shafts have some elasticity and there is some bearing play and the rockerarms transfer such effects to the valves. Under unfavorable conditions, such continuous stresses may even lead to breakage of the rocker arm shaft and, consequently, total failure of the arrangement. Furthermore, it is disadvantageous that the bearing sockets are integrally manufactured with the cylinder head which, for forming the rocker shaft bearing, must be machined in a relatively expensive way. For repairing such camshaft bearings, the whole cylinder head has to be replaced.

It is the object of the present invention to provide a simple arrangement for supporting a cam shaft and the rocker arms for operating the intake and exhaust valves of an internal combustion engine which arrangement requires little mounting space, yet provides for high stability of the rocker arm shaft.

SUMMARY OF THE INVENTION

In an arrangement for mounting a cam shaft and associated valve control elements on an internal combustion engine which has a cylinder head with intake and exhaust valves operated by an overhead cam shaft via rocker arms, the camshaft is rotatably supported on a cam shaft housing having spaced bearing blocks and girders extending between the bearing blocks and having longitudinally extending bores receiving rocker arm support shafts and the girders have spaced recesses wherein rocker arms are pivotally supported on the rocker arm support shaft.

The arrangement requires little mounting space on the cylinder head and the cam shaft housing can be mounted preassembled with camshaft and rockerarms, onto the cylinder head.

The camshaft is supported solely by the camshaft support port housing which consists of support blocks interconnected by girders so that the requirement for expensive machining procedures on the cylinder head for forming the bearing structures for the camshaft as eliminated. The rocker arm support shafts do not extend only the support blocks but additionally extends through bores in the girders and are consequently supported also between two adjacent support blocks so that undesirable vibrations of the rocker arm support shafts are eliminated. The support in the girders is interrupted only by recesses in which the rocker arms are received. The rockerarm shaft can be subjected to lateral forces over long periods of time without being detrimentally affected thereby as to its function even after long periods of operation. With this arrangement, accurate valve control is possible over long periods.

The recesses are preferably arranged at the side of the girder and have, when seen from the top of the cylinder head, an about rectangular shape. The recesses are open toward the side and receive the rocker arms in such a way that the rocker arms are free to move as intended. The recesses can De formed in a simple operating, for example, by milling.

In another advantageous embodiment, the girder includes two longitudinal bores extending parallel to the cam shaft and receiving the two rocker arm support shafts wherein the cavities are arranged in a particular girder section, diametrically across from one another. The rocker arm shafts are fully received within the girder and are supported therein except for the areas of the recesses. The recesses are preferably arranged spaced from one another in axial direction of the rocker arm support shaft. Preferably, the girder width is greater than the combined depth of the two recesses extending into the girder from opposite sides thereof so that there remains a web structure in the center of the girder which is not interrupted by recesses and which provides for good rigidity of the girder.

The rocker arm shaft is suitably arranged in the camshaft housing between the cylinder head and the cam shaft. The rocker arm shaft is therefore disposed adjacent the top side of the cylinder head so that the valve shaft of the intake and exhaust valves can be very short. The cam shaft housing can therefore be designed with low height. It is also advantageous that the cam shaft extends through the cam shaft housing remote from the cylinder head and is supported independently of the cylinder head. The cam shaft housing can be installed onto the cylinder head with all components such as bearing blocks, bearing covers, girders, camshaft, rockerarm support shaft and rockerarms all mounted in a preassembled component; further machining of the cylinder head is eliminated.

Preferably, the bore receiving the rocker arm support shaft extends through the bearing blocks which are preferably formed to be integral with the girder. Bearing blocks and girder form a rigid building component into which the rocker arm support shaft can be inserted in a simple manner. The cam shaft is arranged above the rocker arm support shaft supported by cam shaft bearings mounted on the bearing blocks by bearing covers disposed thereon. For assembly, the cam shaft is placed into the recesses formed in the bearing blocks as cam shaft bearing parts and the bearing covers are then placed onto the beating blocks and anchored thereto.

Advantageous embodiments of the invention will be described below in greater detail on the basis of the accompanying drawings.

DESCRIPTION OF PREFERRED EMBODIMENTS

Figure 1:
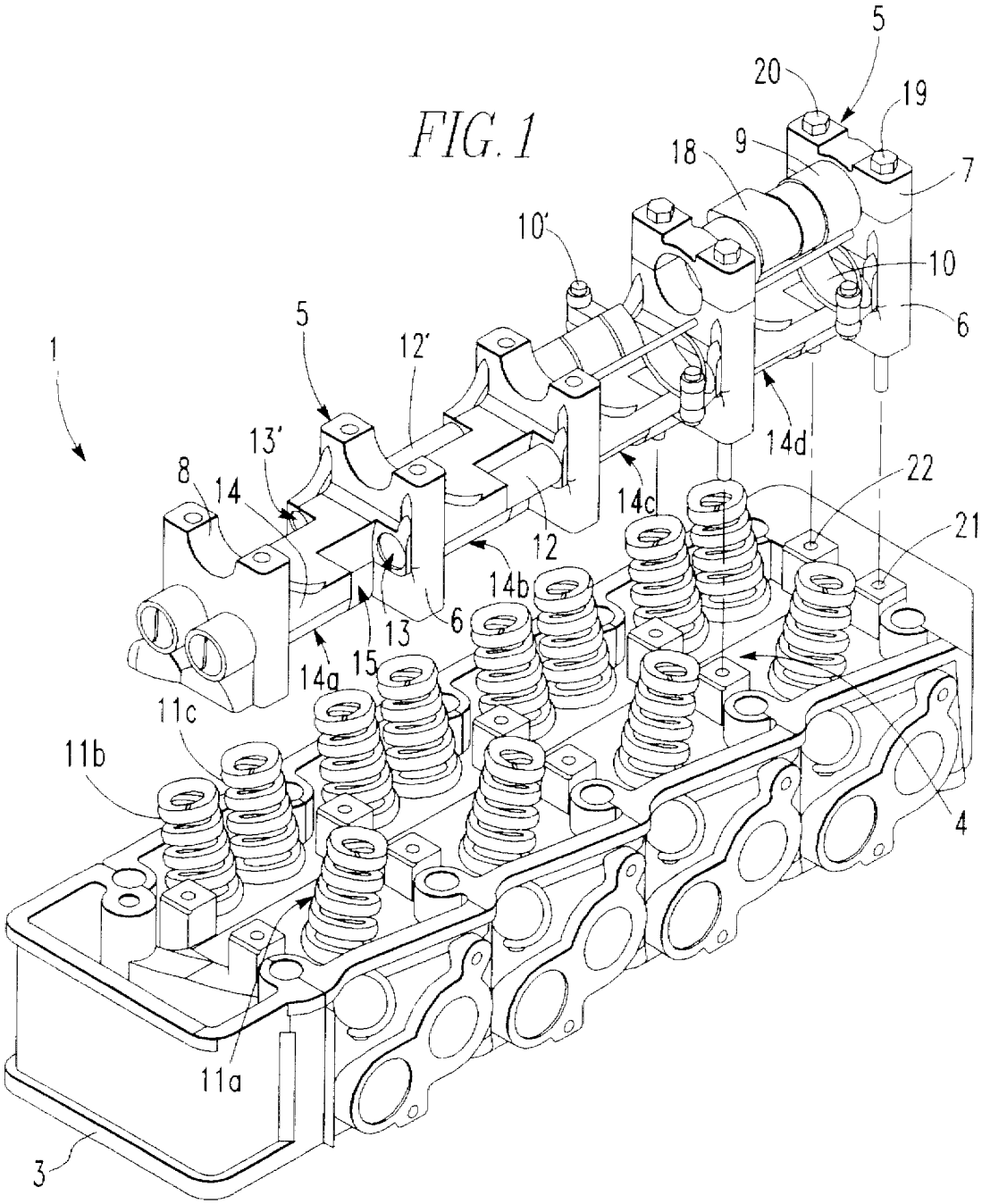
FIG. 1 is a perspective view of a camshaft housing adapted for mounting on a cylinder head (shown 3 valves for each cylinder)

FIG. 1 shows the cylinder head 3 of an inline four cylinder engine with three valves 11*a*, 11*b*, 11*c* per cylinder. As control elements for the intake and exhaust valves of the internal combustion engine, there are provided rocker arms 10, 10' which are mounted in a camshaft housing which is mounted onto the top side 4 of the cylinder head 3. The camshaft housing 1 includes four different sections, one for each cylinder wherein, in FIG. 1, each section is shown in a different state of assembly.

Each valve consists of a valve shaft 27 (FIG. 3) and a valve disc 28 which cyclically opens and closes the intake or, respectively, exhaust gas channel to or from the combustion chamber of each cylinder. The valves 11*a*, 11*b*, 11*c* are forced downwardly to their open positions against the force of a coil spring 29 which is supported at one end on the cylinder head and, at its opposite end remote from the cylinder head, on a dished washer 30 of the valve. Each rocker arm 10, 10' is provided with a bolt 31 with a ball shaped head which engages the associated valve by way of slide shoe 34, 35 for moving the valve to its open position.

The rocker arms 10, 10' are pivotally supported by two rocker arm support shafts 12, 12' arranged in axially parallel relationship. The rocker arm support shafts 12, 12' are supported in bores 13, 13' extending through the bearing support blocks 5. In the embodiment shown, the camshaft housing 1 includes five support blocks 5 which divide the camshaft housing into the four distinct sections. The rocker arms 10, 10' are operated by the cams 18 of a cam shaft 9 which is rotatably supported by camshaft bearings 8 mounted in the support blocks 5. Each bearing support block 5 consists of a bearing base 6 disposed on the cylinder head and a bearing cover 7 mounted onto the bearing base 6 by two vertically extending bolts 19, 20. The bolts 19, 20 extend through the bearing base and are screwed into threaded openings 21, 22 in the cylinder head 3.

Every two adjacent bearing support blocks 5 are interconnected by a girder portion 14. The altogether five bearing support blocks are interconnected by four girder portions 14*a* to 14*d* so that the camshaft housing becomes an integral rigid component.

The support structure for a camshaft and several control elements (rocker arms) takes little space but provides for high stability of the rocker arm support shaft 12. The cam shaft housing 1 comprising the support blocks 5 and the girder 14 can be mounted on the cylinder head fully assembled. The bore 13 for the rocker arm support shaft 12 extends through the girder and the girder has recesses 15 for receiving the rocker arms 10. Correspondingly, the parallel rocker arm support shaft 12' is supported in a bore 13' in the girder 14 and recesses 15' are provided for receiving the rocker arms 10' supported thereby. The rocker arm support shafts 12, 12' are therefore supported not only in the area of the support blocks 5 but are additionally supported in the portions of the girder 14 disposed between the recesses and the support blocks. Consequently, the rocker arm support shafts 12, 12' are supported over most of their length and cannot be bent by transverse forces. The occurrence of bending vibrations which could detrimentally affect the accuracy of valve control is therefore essentially prevented. The rocker arm shafts 12, 12' are accessible only in the area of the recesses 15, 15' which receive the rocker arms so that the stability of the rocker arm shafts is very high. The cam shaft is supported independently of the cylinder head, exclusively by the cam shaft housing so that assembly work and service activities are clearly simplified because the cam shaft housing can be machined without, and independently of, the cylinder head and can be installed on the cylinder head in a preassembled state.

Figure 2:
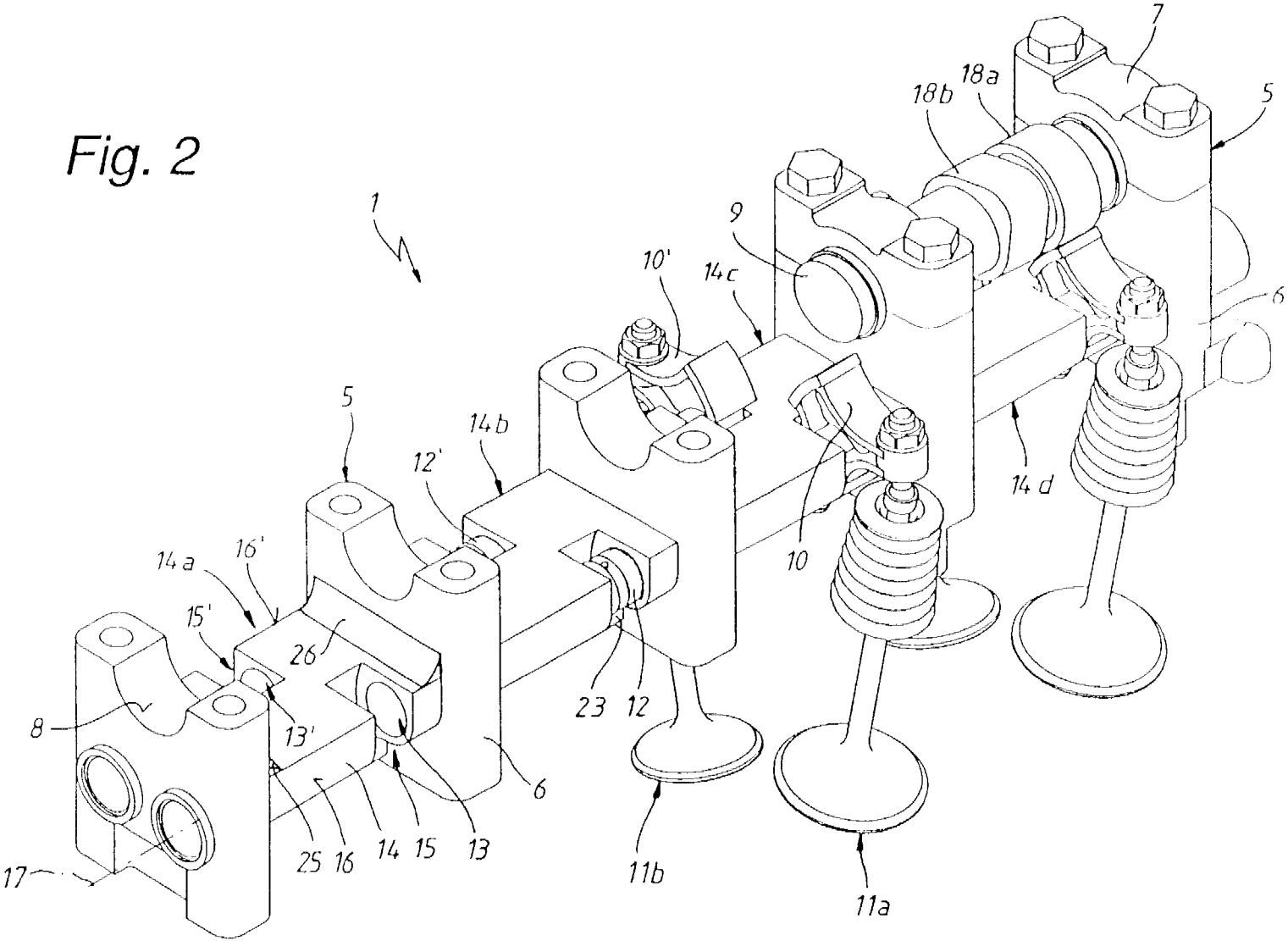
FIG. 2 is a perspective view of a camshaft housing according to the invention with two valves for each cylinder.

FIG. 2 is an enlarged view of the camshaft housing 1 for an arrangement with two valves per cylinder. In the area of each girder section 14*a* to 14*d*, one intake and one exhaust valve 11*a*, 11*b* is arranged which are operated by a cam 18*a* and, respectively, 18*b* of the camshaft 9 by way of rocker arms 10.

Suitably, the girder 14 include two axial parallel bores 13, 13' for the rocker arm support shafts 12, 12' wherein the recesses 15,15' for the rocker arms 10, 10' are arranged at opposite sides 16, 16' of the girder 14. The rocker arm support shafts 12, 12' which extend parallel to the camshaft are both arranged at the same distance from the cylinder head and extend parallel to the top surface of the cylinder head. By supporting the rocker arms on two spaced rockerarm support shafts 12, 12', the intake and exhaust valves can be easily arranged so as to be inclined with respect to one another thereby providing for opening and closing motion of the intake and exhaust valves in different directions during intake and exhaust cycles.

The girder 14 is essentially rectangular in cross-section and the recesses 15, 15' are formed at the narrow sides 16, 16' of the girder 14. The recesses 15, 15' have also, as seen in a top view, an rectangular shape so that they can be made in a simple manner, for example, by milling. Adjacent the cylinder head, the recesses may be limited by partially circular projections 23 which are preferably integral with the girder 14 (see FIG. 2). the rocker arm shafts 12 and 12' are disposed on top of the partially circular projection 23 and are radially supported on that projection also in the area of the recesses 15, 15'.

Figure 4:
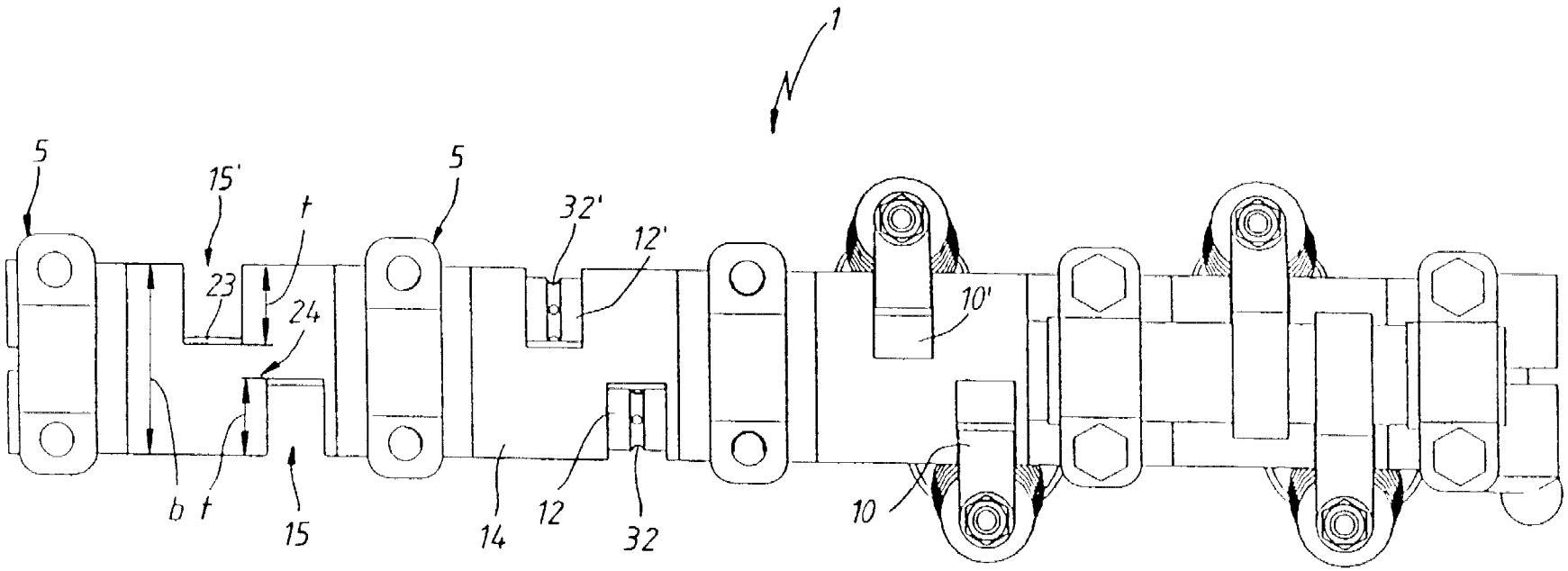
FIG. 4 is a top view of the camshaft housing shown in FIGS. 2 and 3.

Preferably, the recesses 15, 15' are arranged in each longitudinal section 14*a*–14*d* diametrically with respect to one another and, as shown in FIG. 4, the width b of the 0 girder is greater than the combined depth of the recesses extending into the girder from opposite sides. In this way, a continuous web 24 is formed in the girder 14 which extends longitudinally between adjacent support blocks 5 and which is not interrupted by the recesses. This arrangement provides for high rigidity of the girder 14.

FIG. 4 also shows that the rocker arm support shafts have a circumferential groove 32, 32' in the area of the recesses 14 which serves for the supply of oil to the interface between the rocker arms and the rocker arm support shaft.

The bearing support blocks 5 and the girder can be formed as an integral casting. As shown in FIG. 2, the transition areas between the girders and the support blocks 5 may be rounded as indicated by reference numerals 25, 26.

Figure 3:
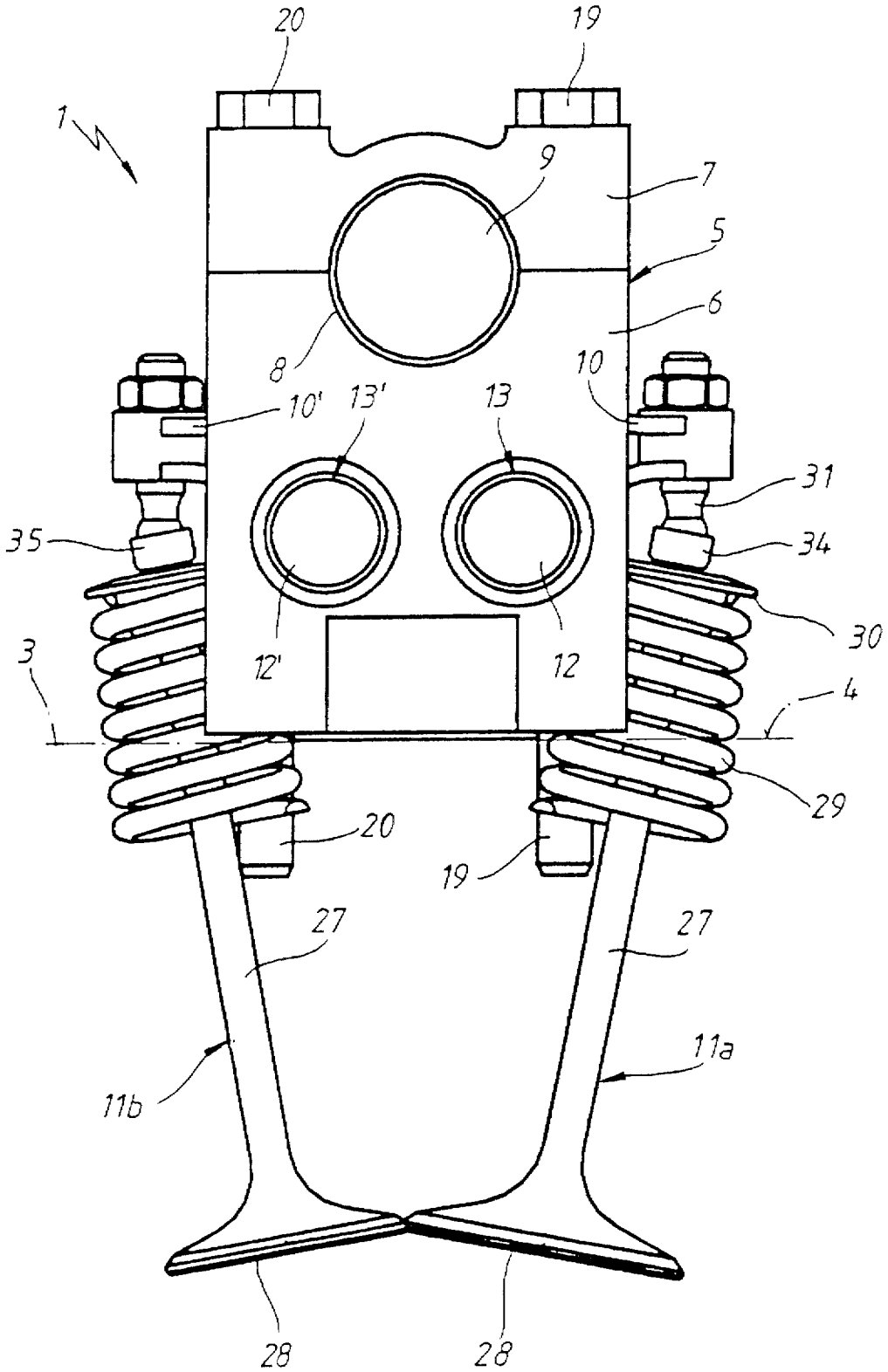
FIG. 3 is a side view of the camshaft housing shown in FIG. 2.

As can be seen from FIG. 3, the rocker arm support shafts 12, 12' are arranged in the camshaft housing 1 between the cylinder head 3 and the camshaft 9. The rocker arm support shafts extend below the camshaft so that the distance between the rocker arm shafts and the cylinder head 3 is as small as possible. Accordingly, also the portion of valve shaft 27 of each a valve 11*a*, 11*b* which projects from the cylinder head is relatively short so that the height of the whole arrangement can be relatively small. In addition, a highly accurate valve timing control is achieved since undesirable lateral movement of the valve is essentially eliminated because of the relatively short valve stem part projecting from the cylinder head. Furthermore, it is advantageous that the camshaft bearing is totally integrated into the support block 5 whereby the need for machining the cylinder head to provide support for the camshaft is eliminated. The camshaft housing 1 can be a completely preassembled building component which includes all elements such as bearing support blocks, bearing covers, girders, camshaft, rocker arm support shaft and rocker arms and can be attached to the cylinder head in preassembled state by bolts 19, 20.

Preferably, the bores 13, 13' receiving the rocker arm shafts extend through the bearing support bases 6. The camshaft bearing 8 is defined by the bearing support bases and the bearing covers 7 wherein, as shown in FIG. 3, about semicircular cavities are provided in the support bases 6 and in the bearing covers 7 which, combined, form the camshaft bearing 8. During assembly, the camshaft 9 is simply placed into the semicircular cavity in the support base 6 and the bearing cover is then placed onto, and bolted to, the supported base 6 whereby the camshaft is firmly mounted in the camshaft housing 1.

In the arrangement according to FIG. 3, only one rocker arm support shaft 12 is provided in the girder 14 between adjacent support blocks 5. The camshaft housing 1 is shown without the camshaft and without the bearing cover. The girder 14 includes two diametrically opposite recesses 15 which are displaced longitudinally and the recesses 15, arranged at opposite sides 16, 16', are separated by a transverse web 33 of the girder 14. Into each of the recesses 15, a rockerarm (not shown) can be inserted which operates a particular intake or exhaust valve. The depth t of each recess in this case is greater than half the width b of the girder at least by an amount corresponding to the shaft radius of the rocker arm shaft 12. This results in a particularly compact design since only one rocker arm support shaft is provided for supporting the rocker arms.

Figure 5:
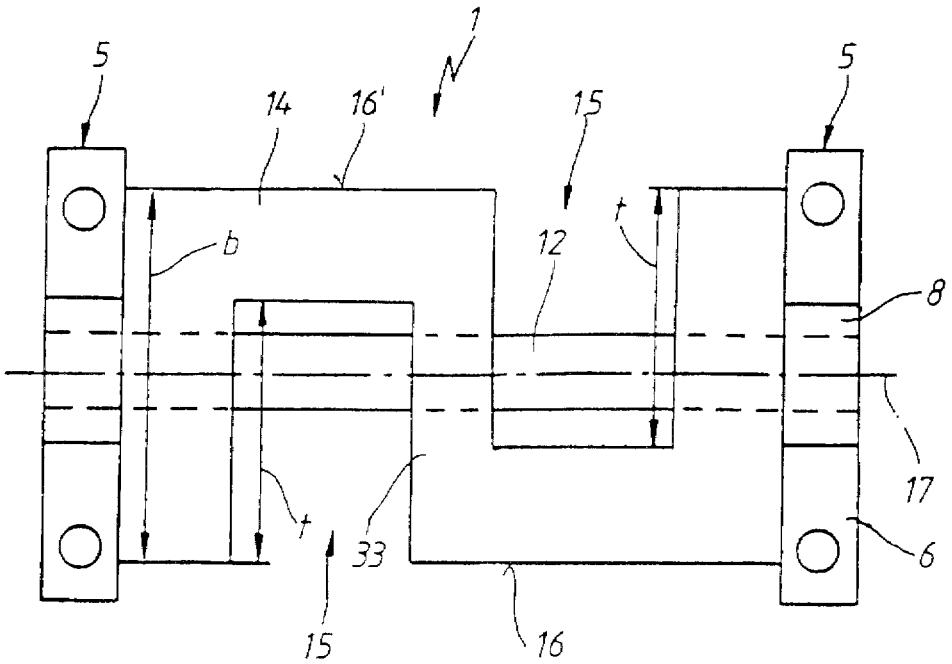
FIG. 5 is a top view of a portion of the camshaft housing of FIGS. 2 and 3.
Figure 6:
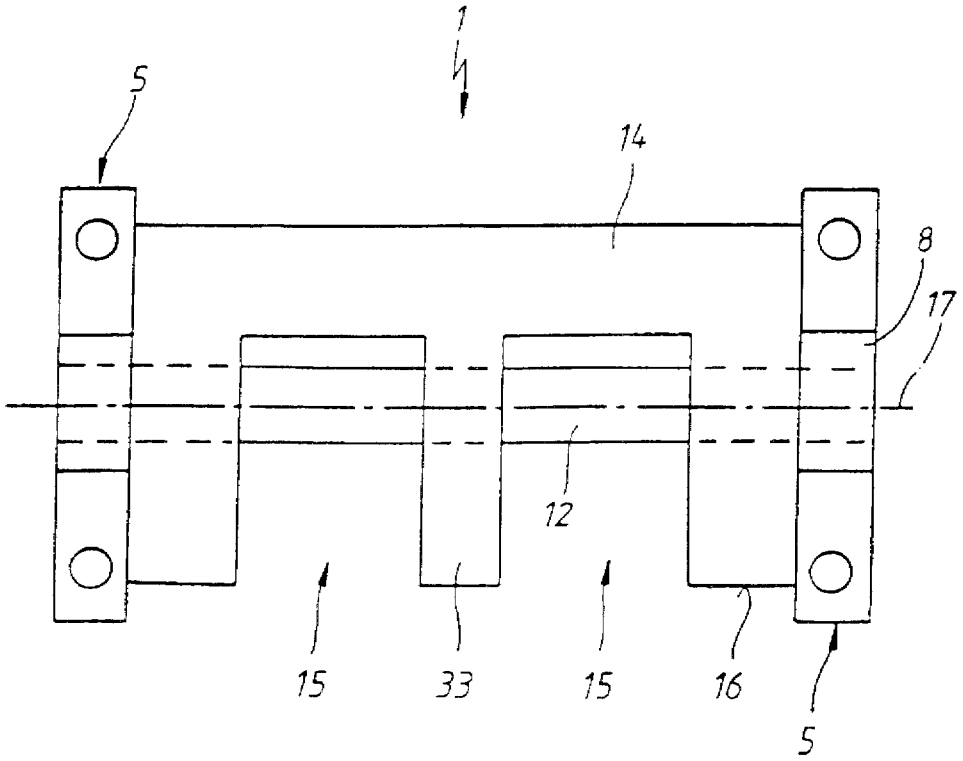
FIG. 6 is a top view of a portion of a cam shaft housing for another embodiment of the invention.

FIG. 6 shows an arrangement similar to that of FIG. 5 for a camshaft housing 1. The rocker arm support shaft 12 is supported in the girder 14 between the support blocks 5. The recesses 15 for the rocker arms are both provided at the same side 16 of the girder and are spaced from one another in longitudinal direction of the bore axis 17. Between the two recesses 15, there is the transverse web 33 which is formed integrally with the girder 14, so that the rocker arms in both recesses abut the side walls of the web 33 and are accurately guided thereby.

What is claimed is:

1. An arrangement for mounting a camshaft and associated valve control elements on an internal combustion engine having a cylinder head with intake and exhaust valves and an overhead camshaft extending longitudinally on said cylinder head for operating said intake and exhaust valves, said arrangement comprising a camshaft housing having spaced bearing blocks with bearing covers rotatably supporting said camshaft and girders extending between said bearing blocks and having at least one longitudinal bore, a rocker arm support shaft extending through said bore, said girder having recesses wherein said rocker arm support shaft is exposed and rocker arms received in said recesses and pivotally supported therein on said rocker arm support shaft.

2. An arrangement according to claim 1, wherein said recesses are formed in the side of said girder and have a rectangular shape when viewed in the direction toward the cylinder head.

3. An arrangement according to claim 1, wherein said camshaft housing has two parallel bores each receiving one rocker arm support shaft and said recesses for said rocker arm support shafts extend into said girders from opposite sides thereof.

4. An arrangement according to claim 3, wherein said opposite recesses are arranged displaced with respect to one another in axial direction of the bores.

5. An arrangement according to claim 3, wherein the width of the girder is greater than the combined depth of said recesses.

6. An arrangement according to claim 1, wherein said camshaft housing includes only one rocker arm support shaft and said recesses have a depth greater than half the width of said girder.

7. An arrangement according to claim 6, wherein said recesses at opposite sides of said girder are arranged so as to be diametrically displaced with respect to one another.

8. An arrangement according to claim 6, wherein said recesses extend into said girder only from one side thereof and are separated from one another by a transverse web disposed therebetween.

9. An arrangement according to claim 1, wherein said bearing block and said girder are an integral component.

10. An arrangement according to claim 1, wherein said rocker arm shaft is arranged in said camshaft housing between said cylinder head and said cam shaft.

11. An arrangement according to claim 10, wherein said bore receiving said rocker arm shaft extends through said bearing blocks.

12. An arrangement according to claim 11, wherein said camshaft bearing is formed in said bearing block between a base and the cover thereof.

13. An arrangement according to claim 1, wherein said camshaft housing is mounted on said cylinder head by bolts extending through said bearing cover and said bearing block.

* * * * *